US012535221B2

(12) United States Patent
Pierce

(10) Patent No.: US 12,535,221 B2
(45) Date of Patent: Jan. 27, 2026

(54) COOKTOP APPLIANCE WITH UNIFYING ALIGNMENT BRACKET

(71) Applicant: Haier US Appliance Solutions, Inc., Wilmington, DE (US)

(72) Inventor: Andrew Pierce, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 1127 days.

(21) Appl. No.: 17/513,051

(22) Filed: Oct. 28, 2021

(65) Prior Publication Data

US 2023/0136332 A1 May 4, 2023

(51) Int. Cl.
*F24C 3/12* (2006.01)
*F24C 3/10* (2006.01)

(52) U.S. Cl.
CPC ..... *F24C 3/126* (2013.01); *F24C 3/103* (2013.01)

(58) Field of Classification Search
CPC ..... F24C 3/126; F24C 3/103; F24C 3/124; F24C 3/128; F24C 3/12; F24C 3/122
USPC ..... 126/39 R, 39 B
See application file for complete search history.

(56) References Cited

U.S. PATENT DOCUMENTS

| | | | | |
|---|---|---|---|---|
| 9,476,594 | B2 | 10/2016 | Fockler | |
| 9,976,749 | B2 | 5/2018 | Yang | |
| 10,677,470 | B2 | 6/2020 | Beghi | |
| 10,907,837 | B2 | 2/2021 | Roberts | |
| 12,104,801 | B2 * | 10/2024 | Sanchez Rodriguez | F24C 3/126 |
| 2017/0089586 | A1 | 3/2017 | Turner | |
| 2017/0191671 | A1 | 7/2017 | Chambers | |
| 2019/0178499 | A1 | 6/2019 | Dolinski | |
| 2022/0299204 | A1 * | 9/2022 | Cowan | F23N 1/005 |

* cited by examiner

*Primary Examiner* — Vivek K Shirsat
(74) *Attorney, Agent, or Firm* — Dority & Manning, P.A.

(57) ABSTRACT

A cooktop appliance includes a panel defining a plurality of openings. The panel may also include a plurality of clearance holes or a plurality of alignment slots, with each hole or slot positioned adjacent one respective opening. The cooktop appliance also includes a plurality of control valves mounted to the panel, each including a spark switch and a stem. The stem of each control valve extends through the panel at one corresponding opening. The cooktop appliance further includes a plurality of knobs, each knob mounted to a respective one control valve. The cooktop appliance also includes a unifying bracket positioned between the spark switches of the control valves and the panel. The unifying bracket includes a plurality of protrusions. Each protrusion may extend through a respective one alignment slot or through a respective one clearance hole.

20 Claims, 16 Drawing Sheets

COOKTOP APPLIANCE WITH UNIFYING ALIGNMENT BRACKET

FIELD OF THE INVENTION

The present subject matter relates generally to cooktop appliances, such as gas cooktop appliances.

BACKGROUND OF THE INVENTION

Gas cooktop appliances generally include multiple gas burners mounted to a top panel. A user of the cooktop appliances may regulate fuel flow to the gas burners by adjusting control valves associated with the gas burners. Certain gas cooktop appliances includes knobs coupled to the control valves. The user may rotate the knobs to open and close the control valves and thereby regulate fuel flow to the gas burners.

A knob bezel may be mounted to a gas cooktop's panel below a knob in order to hide or cover a gap between the knob and the panel. Thus, the knob bezel may improve a cosmetic appearance of the gas cooktop. The knob bezel is generally a separate piece of material from the knob and control valve. Since the knob bezel is not an integrated part of the knob or control valve, properly aligning the knob bezel with the knob on the gas cooktop's panel can be difficult. A misaligned knob bezel can be visually displeasing and can also result in binding between the knob and knob bezel during rotation of the knob relative to the knob bezel. Additionally, the knobs may be misaligned with each other, such as adjacent knobs may be misaligned. Knob to knob misalignment can also be visually displeasing.

Accordingly, a cooktop appliance with features for aligning a plurality of knobs and respective bezels with each other would be useful.

BRIEF DESCRIPTION OF THE INVENTION

Aspects and advantages of the invention will be set forth in part in the following description, or may be apparent from the description, or may be learned through practice of the invention.

In an exemplary embodiment, a cooktop appliance is provided. The cooktop appliance includes a panel defining a plurality of openings with a plurality of clearance holes defined in the panel. Each clearance hole of the plurality of clearance holes is positioned adjacent a respective one opening of the plurality of openings. The cooktop appliance also includes a plurality of control valves mounted to the panel. Each control valve of the plurality of control valves includes a spark switch and a stem. The stem of each control valve extends through the panel at one corresponding opening of the plurality of openings of the panel. The cooktop appliance further includes a plurality of knobs. Each knob is mounted to the stem of a respective one control valve of the plurality of control valves and is positioned opposite the spark switch of the respective one control valve about the panel. The cooktop appliance also includes a plurality of bezels positioned at the panel such that each bezel of the plurality of bezels is disposed between a corresponding one knob of the plurality of knobs and the panel. Each bezel of the plurality of bezels includes a control slot defined therein. The cooktop appliance further includes a unifying bracket positioned between the spark switch of each control valve of the plurality of control valves and the panel. The unifying bracket includes a plurality of protrusions. Each protrusion of the plurality of protrusions of the unifying bracket extends through a respective one of the plurality of clearance holes in the panel and through the control slot of a respective one bezel of the plurality of bezels.

In another exemplary embodiment, a cooktop appliance is provided. The cooktop appliance includes a panel defining a plurality of openings with a plurality of alignment slots defined in the panel. Each alignment slot of the plurality of alignment slots is positioned adjacent a respective one opening of the plurality of openings. The cooktop appliance also includes a plurality of control valves mounted to the panel. Each control valve of the plurality of control valves includes a spark switch and a stem. The stem of each control valve extends through the panel at one corresponding opening of the plurality of openings of the panel. The cooktop appliance further includes a plurality of knobs. Each knob is mounted to the stem of a respective one control valve of the plurality of control valves and is positioned opposite the spark switch of the respective one control valve about the panel. The cooktop appliance also includes a unifying bracket positioned between the spark switch of each control valve of the plurality of control valves and the panel. The unifying bracket includes a plurality of protrusions. Each protrusion of the plurality of protrusions of the unifying bracket extends through a respective one of the plurality of alignment slots.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
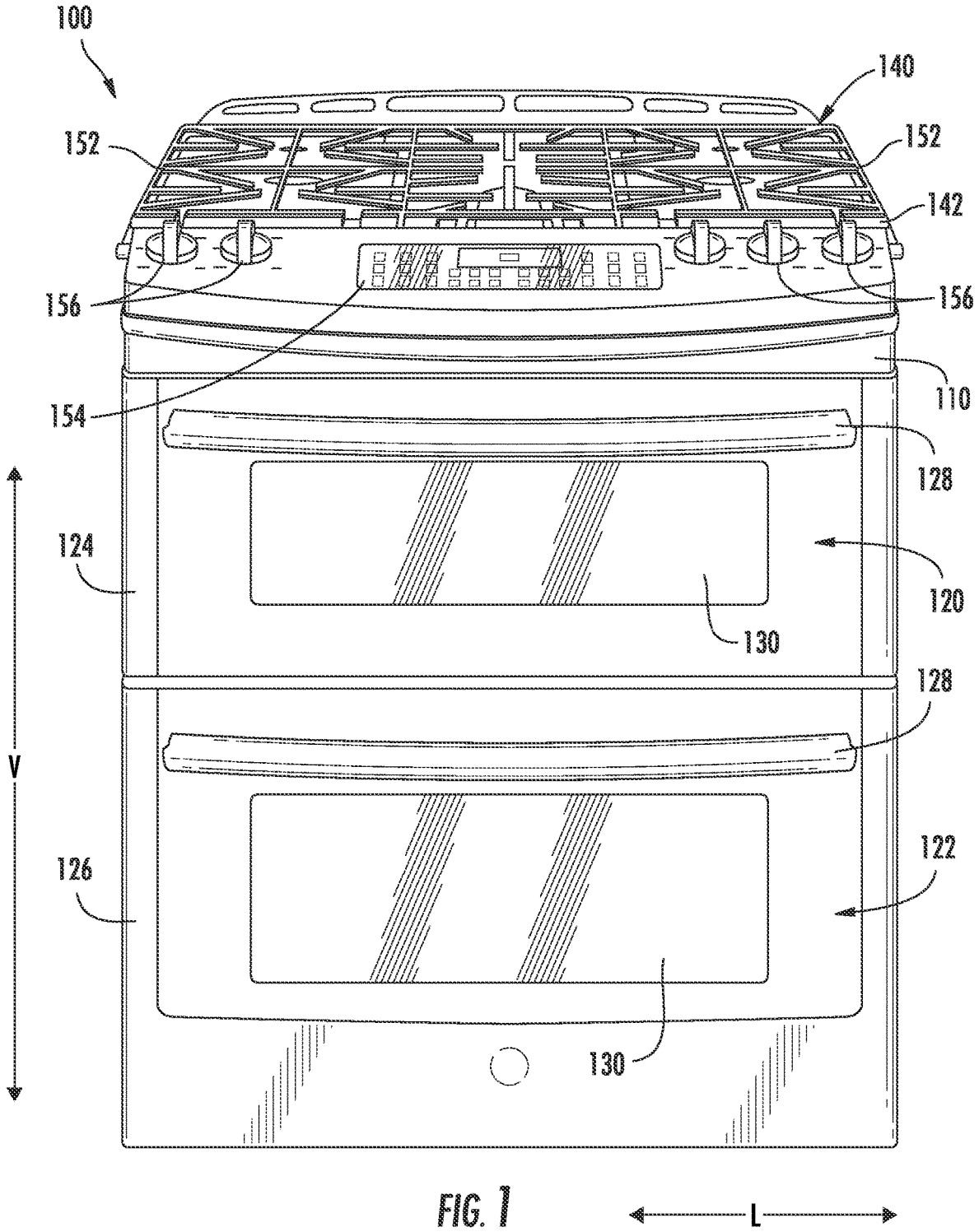
FIG. 1 provides a front, perspective view of a range appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
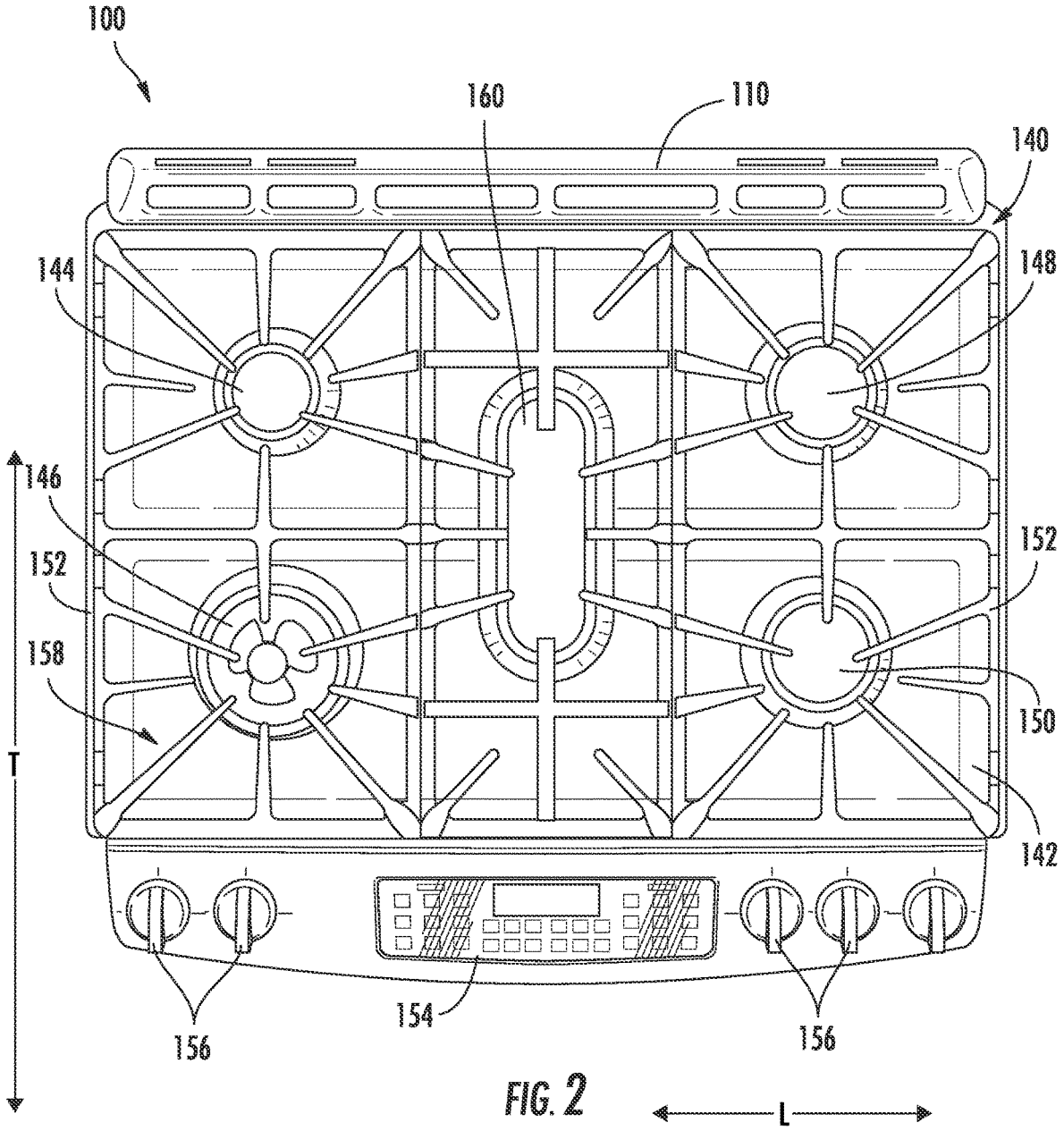
FIG. 2 provides a top view of the exemplary range appliance of FIG. 1.

Referring now to the figures, an exemplary appliance will be described in accordance with exemplary aspects of the present subject matter. FIG. 1 provides a front, perspective view of a range appliance 100 as may be employed with the present subject matter. FIG. 2 provides a top, plan view of range appliance 100. Range appliance 100 includes an insulated cabinet 110. As illustrated, range appliance 100 generally defines a vertical direction V, a lateral direction L, and a transverse direction T, each of which is mutually perpendicular, such that an orthogonal coordinate system is generally defined. Cabinet 110 defines an upper cooking chamber 120 and a lower cooking chamber 122. Thus, range appliance 100 is generally referred to as a double oven range appliance. As will be understood by those skilled in the art, range appliance 100 is provided by way of example only, and the present subject matter may be used in any suitable cooktop appliance, e.g., a single oven range appliance or a standalone cooktop appliance. Thus, the exemplary embodiment shown in FIG. 1 is not intended to limit the present subject matter to any particular cooking chamber configuration or arrangement.

Upper and lower cooking chambers 120 and 122 are configured for the receipt of one or more food items to be cooked. Range appliance 100 includes an upper door 124 and a lower door 126 rotatably attached to cabinet 110 in order to permit selective access to upper cooking chamber 120 and lower cooking chamber 122, respectively. Handles 128 are mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Glass window panes 130 provide for viewing the contents of upper and lower cooking chambers 120 and 122 when doors 124 and 126 are closed and also assist with insulating upper and lower cooking chambers 120 and 122. Heating elements (not shown), such as electric resistance heating elements, gas burners, microwave heating elements, halogen heating elements, or suitable combinations thereof, are positioned within upper cooking chamber 120 and lower cooking chamber 122 for heating upper cooking chamber 120 and lower cooking chamber 122.

Range appliance 100 also includes a cooktop 140. Cooktop 140 is positioned at or adjacent a top portion of cabinet 110. Thus, cooktop 140 is positioned above upper and lower cooking chambers 120 and 122. Cooktop 140 includes a top panel 142. By way of example, top panel 142 may be constructed of glass, ceramics, enameled steel, and combinations thereof.

For range appliance 100, a utensil holding food and/or cooking liquids (e.g., oil, water, etc.) may be placed onto grates 152 at a location of any of burner assemblies 144, 146, 148, 150. Burner assemblies 144, 146, 148, 150 provide thermal energy to cooking utensils on grates 152. As shown in FIG. 1, burner assemblies 144, 146, 148, 150 can be configured in various sizes so as to provide e.g., for the receipt of cooking utensils (i.e., pots, pans, etc.) of various sizes and configurations and to provide different heat inputs for such cooking utensils. Grates 152 are supported on a top surface 158 of top panel 142. Range appliance 100 also includes a griddle burner 160 positioned at a middle portion of top panel 142, as may be seen in FIG. 2. A griddle may be positioned on grates 152 and heated with griddle burner 160.

A user interface panel 154 is located within convenient reach of a user of the range appliance 100. For this exemplary embodiment, user interface panel 154 includes knobs 156 that are each associated with one of burner assemblies 144, 146, 148, 150 and griddle burner 160. Knobs 156 allow the user to activate each burner assembly and determine the amount of heat input provided by each burner assembly 144, 146, 148, 150 and griddle burner 160 to a cooking utensil located thereon. User interface panel 154 may also be provided with one or more graphical display devices that deliver certain information to the user such as e.g., whether a particular burner assembly is activated and/or the rate at which the burner assembly is set.

Although shown with knobs 156, it should be understood that knobs 156 and the configuration of range appliance 100 shown in FIG. 1 are provided by way of example only. More specifically, user interface panel 154 may include various input components, such as one or more of a variety of touch-type controls, electrical, mechanical or electro-mechanical input devices including rotary dials, push buttons, and touch pads, e.g., in addition to knobs 156. The user interface panel 154 may include other display components, such as a digital or analog display device designed to provide operational feedback to a user.

Figure 3:
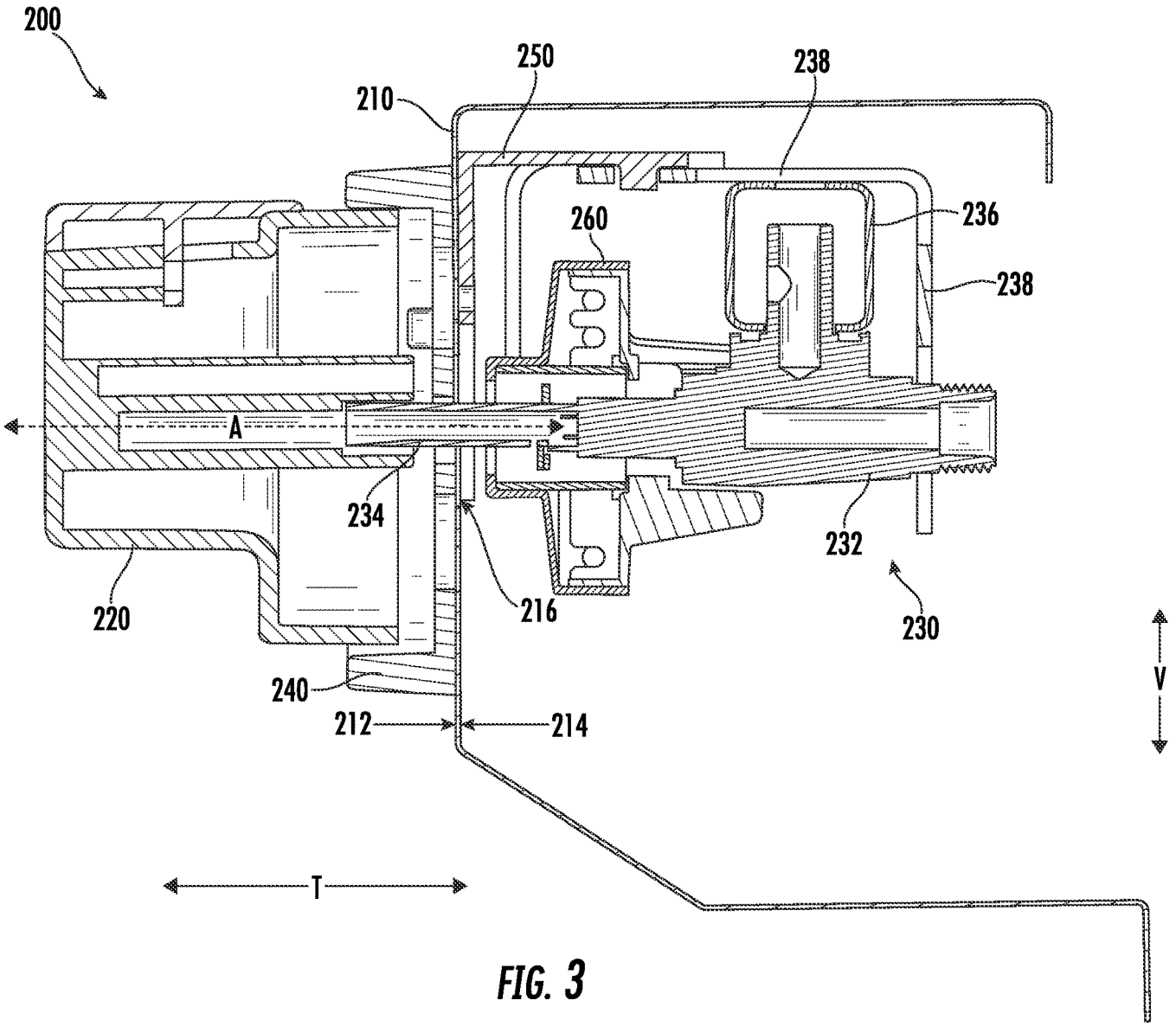
FIG. 3 provides a side section view of a control panel assembly taken through the center of a knob of the control panel assembly according to an exemplary embodiment of the present subject matter and as may be used with the exemplary range appliance of FIG. 1.
Figure 4:
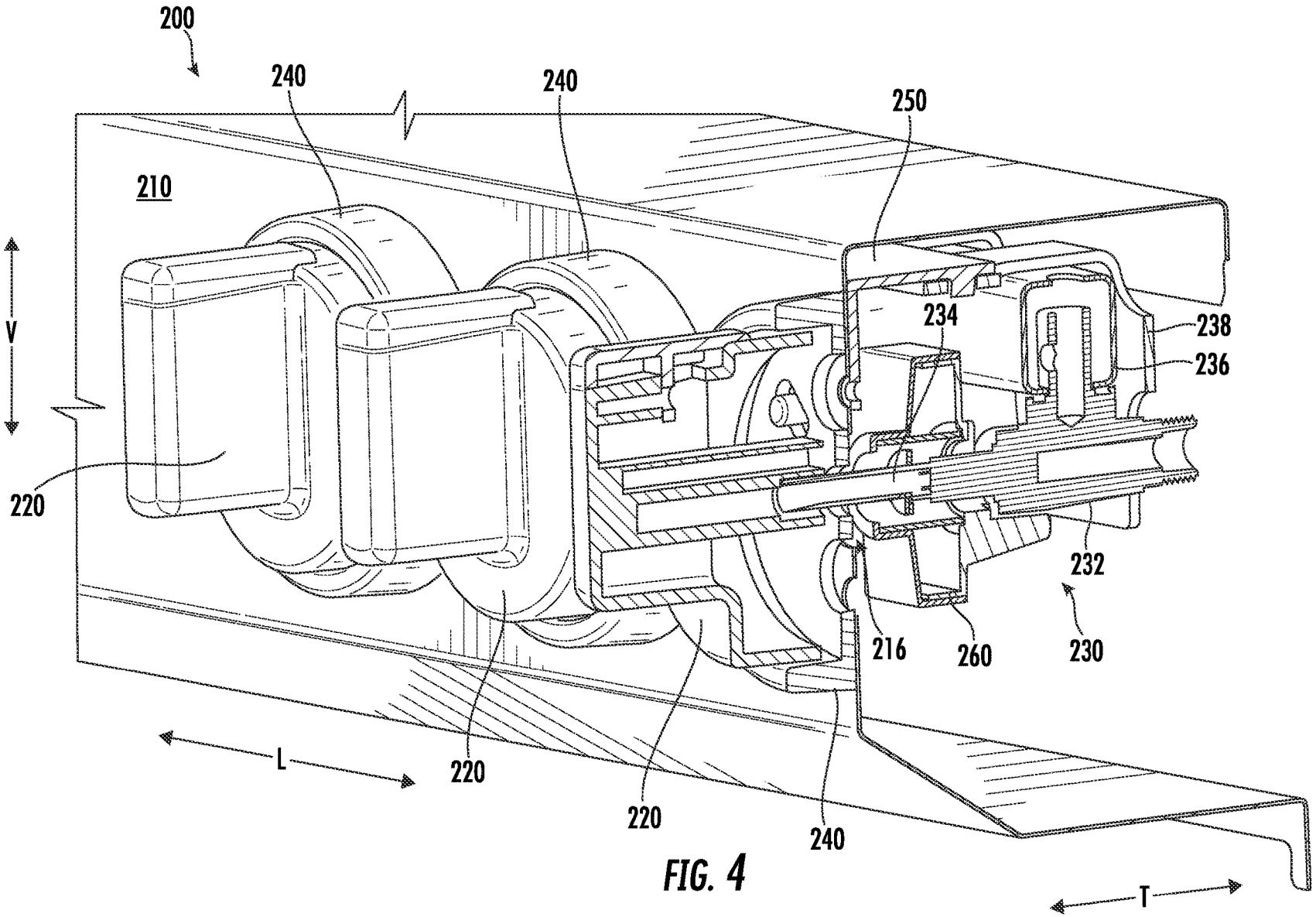
FIG. 4 provides a perspective section view of the exemplary control panel assembly of FIG. 3.
Figure 5:
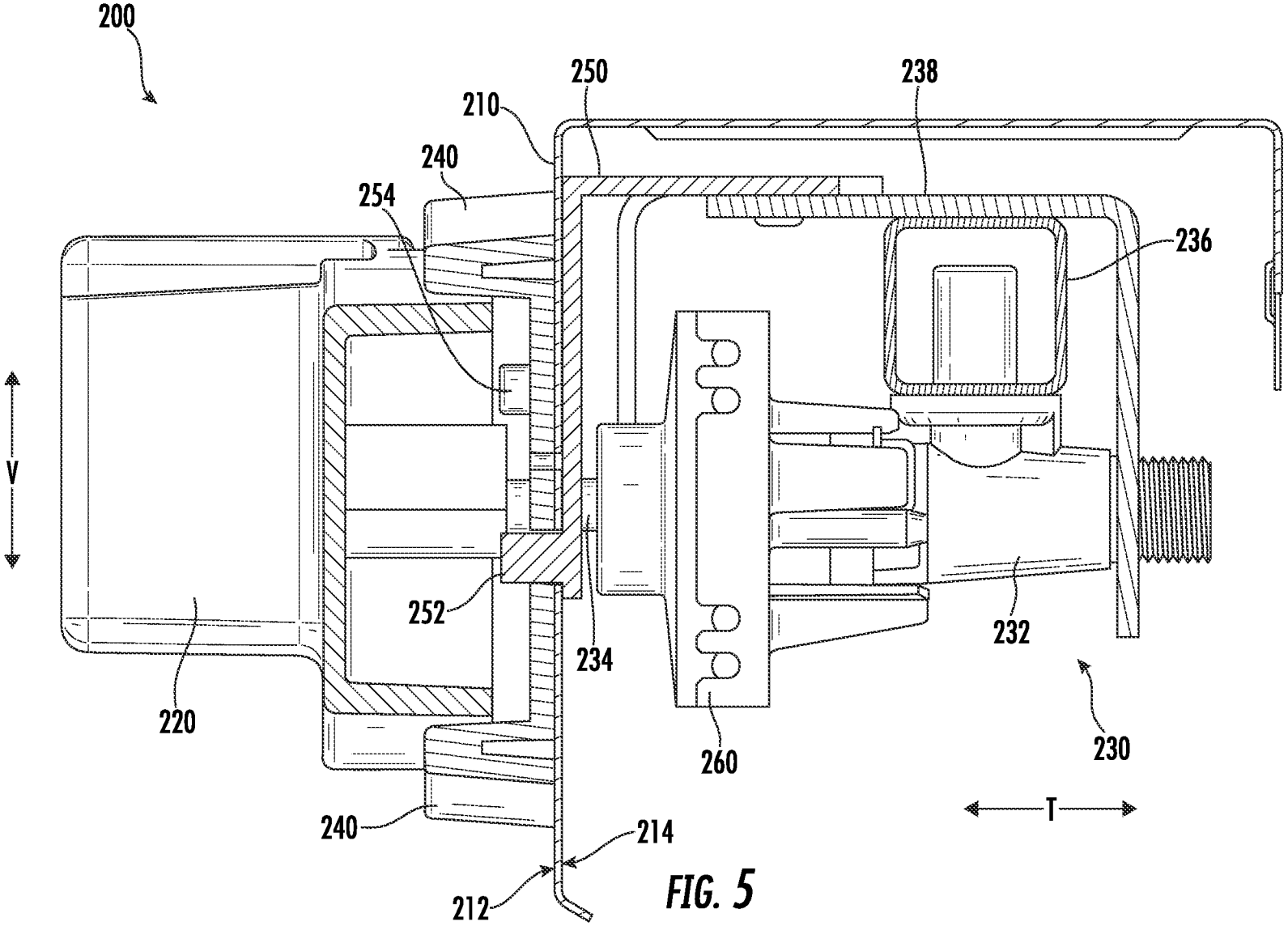
FIG. 5 provides side section view of the exemplary control panel assembly of FIG. 3 taken near an edge of a knob of the control panel assembly.
Figure 6:
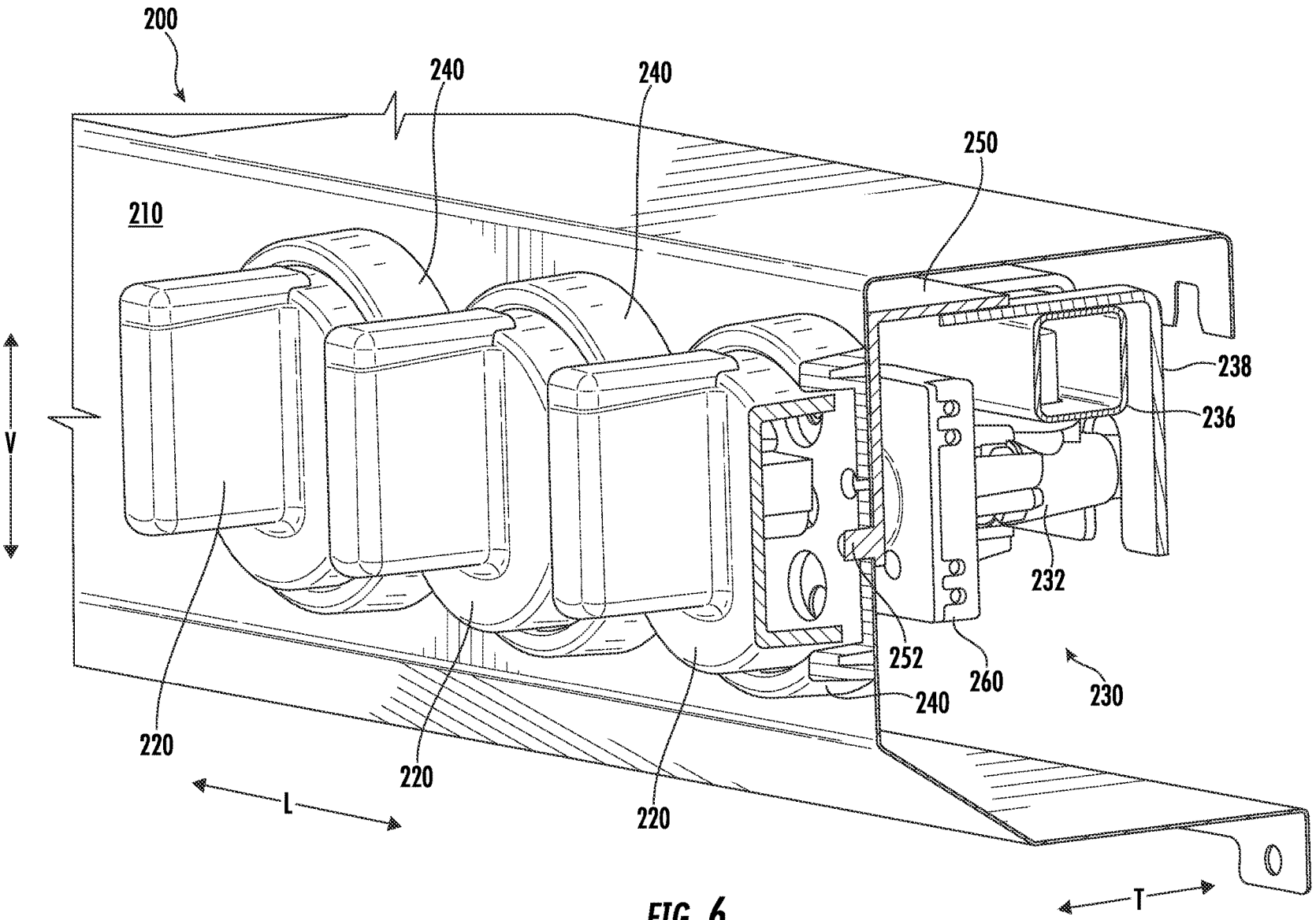
FIG. 6 provides a perspective section view of the exemplary control panel assembly taken along the same section plane as in FIG. 5.

FIG. 3 provides a side, section view of a control panel assembly 200 according to an exemplary embodiment of the present subject matter, where the section cut is taken through a center of one exemplary knob of a plurality of knobs. FIG. 4 provides a perspective section view of control panel assembly 200. FIG. 5 provides a side section view of the control panel assembly 200 taken near an edge of a knob of the control panel assembly 200. FIG. 6 provides a perspective section view of the control panel assembly 200 taken along the same section plane as in FIG. 5. Control panel assembly 200 may be used in or within any suitable cooktop appliance. For example, control panel assembly 200 may be used in or within range appliance 100 of FIGS. 1 and 2. Thus, control panel assembly 200 is discussed in greater detail below in the context of range appliance 100. Further, the vertical direction V, lateral direction L, and transverse direction T may also or instead be defined by and/or relative to the control panel assembly 200. For example, when the control panel assembly 200 is incorporated into the range appliance 100, the vertical direction V, lateral direction L, and transverse direction T noted in FIGS. 3 through 16 correspond to and/or are aligned with the vertical direction V, lateral direction L, and transverse direction T depicted in FIGS. 1 and 2.

As may be seen in FIGS. 3-6, control panel assembly 200 includes a panel 210, a plurality of knobs 220 (e.g., knobs 156) and a plurality of control valves 230. As will be discussed further below, the knobs 220 and the control valves 230 are paired in one-to-one correspondence, e.g., each knob 220 is connected to one corresponding control valve 230 and each control valve 230 has a single knob 220 connected thereto. Panel 210 may be part of top panel 142 of range appliance 100 (FIG. 1) or may be separate from top panel 142. Panel 210 defines an outer surface 212 and an inner surface 214. Outer and inner surfaces 212, 214 of panel 210 are positioned opposite each other on panel 210. For example, inner surface 214 of panel 210 may face an interior of range appliance 100, and outer surface 212 of panel 210 may face away from the interior of range appliance 100. Panel 210 also defines a plurality of openings 216. Each opening 216 of panel 210 extends through panel 210, e.g., between outer and inner surfaces 212, 214 of panel 210.

Each paired knob 220 and control valve 230 are positioned at or adjacent one of the openings 216 of panel 210. As an example, the paired knob 220 and control valve 230 may be positioned opposite each other about panel 210. In particular, each knob 220 may be positioned at or adjacent outer surface 212 of panel 210 proximate opening 216 of panel 210, and each respective control valve 230 may be positioned at or adjacent inner surface 214 of panel 210 proximate the same opening 216 of panel 210 as the knob 220 with which the control valve 230 is connected.

Each control valve 230 includes a valve body 232 and a stem 234. The plurality of control valves 230 are all coupled to a manifold tube 236 and manifold tube 236 includes a manifold bracket 238 thereon. The valve body 232 of each control valve 230 of the plurality of control valves 230 is configured for housing various components of the control valve 230 that regulate a flow of gaseous fuel, such as propane or natural gas, from manifold tube 236 to one of burner assemblies 144, 146, 148, 150. In particular, each control valve 230 is selectively adjustable between an open configuration and a closed configuration. In the closed configuration, the control valve 230 blocks gaseous fuel flow from manifold tube 236. Conversely, each control valve 230 permits gaseous fuel flow from manifold tube 236 in the open configuration. Each stem 234 extends from the valve body 232 through panel 210 at one opening 216 of panel 210. Each knob 220 is coupled (e.g., mounted to) the corresponding one control valve 230 at the stem 234 thereof. As may be seen, e.g., in FIG. 3, each control valve 230 defines an axial direction A along a length of stem 234. A user may rotate knob 220 in order to adjust the control valve 230 paired therewith between the open and closed configurations. A fuel line (not shown) extends from valve body 232 to one of burner assemblies 144, 146, 148, 150 in order to supply fuel from valve body 232 to the corresponding burner assembly.

Each control valve 230 may be mounted to the panel 210. For example, each valve body 232 may be coupled to manifold 236, and manifold bracket 238 may be mounted (e.g., fastened) to a unifying bracket 250 which is in turn mounted to panel 210. Manifold tube 236 may be mounted to (e.g., fastened) to manifold bracket 238. In such a manner, control valve 230 may be connected and mounted to panel 210.

Control panel assembly 200 also includes a plurality of spark switches 260, e.g., each control valve 230 may have a spark switch 260 mounted thereon and/or incorporated therein. Each spark switch 260 is configured for electrically connecting a power supply to an igniter at one of burner assemblies 144, 146, 148, 150. In particular, spark switch 260 may be configured for closing an electrical circuit to the igniter when a user rotates knob 220 such that control valve 230 is in the open configuration, and spark switch 260 may be configured for opening the electrical circuit to the igniter when the user rotates knob 220 such that control valve 230 is in the closed configuration. In such a manner, spark switch 260 may assist with igniting gaseous fuel at burners of range appliance 100, as will be understood by those skilled in the art.

Control panel assembly 200 also includes a plurality of bezels 240. Each bezel 240 is disposed between one respective knob 220 and the panel 210 and each bezel 240 is positioned on panel 210. Each bezel 240 may cover or hide a gap between the respective knob 220 and the panel 210 in order to improve a cosmetic appearance of range appliance 100, such as each bezel 240 may cover a portion of the respective opening 216 in the panel 210 through which the corresponding valve stem 234 extends.

Figure 7:
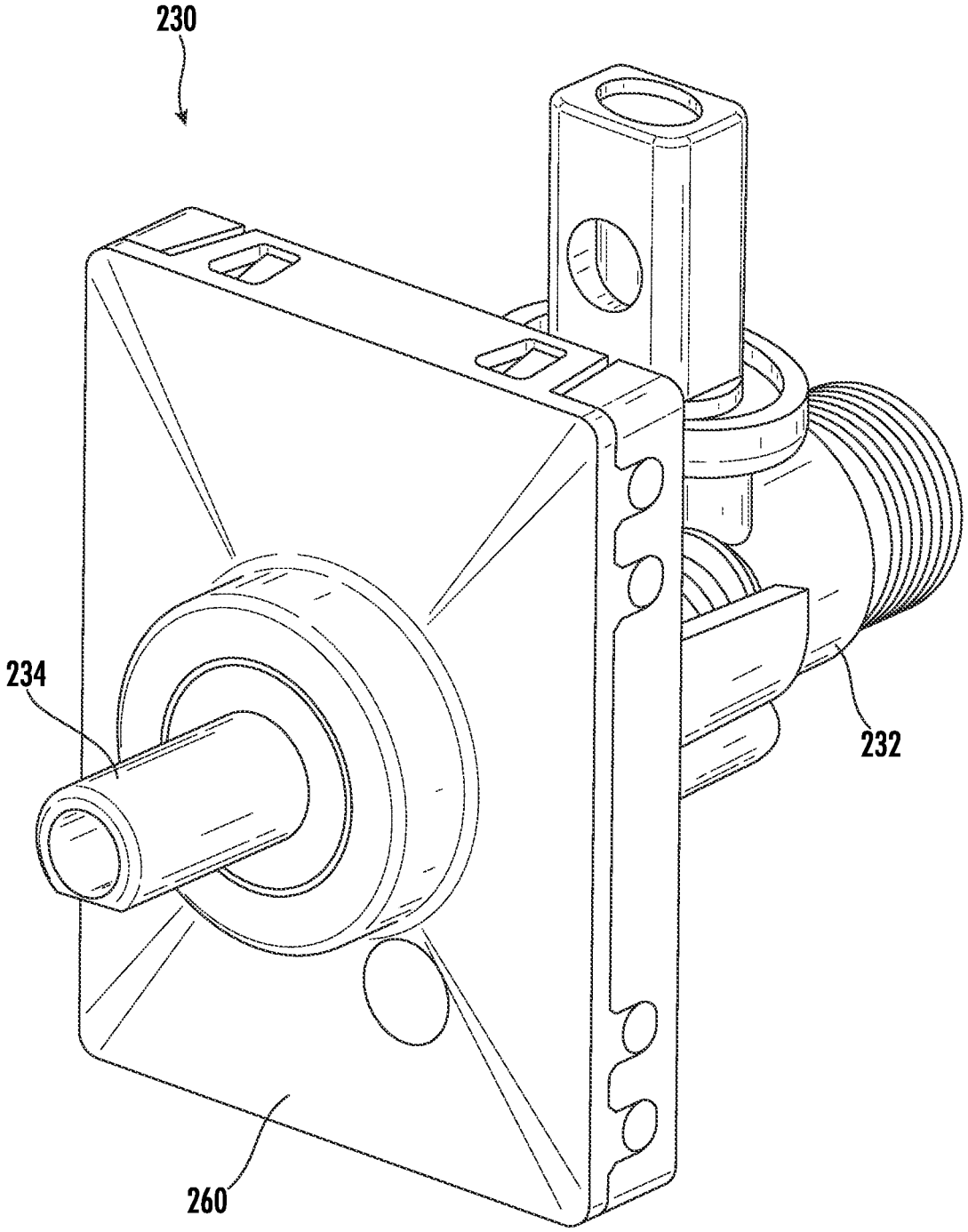
FIG. 7 provides a perspective view of an exemplary control valve as may be incorporated into a control panel assembly such as the exemplary control panel assembly of FIG. 3.
Figure 8:
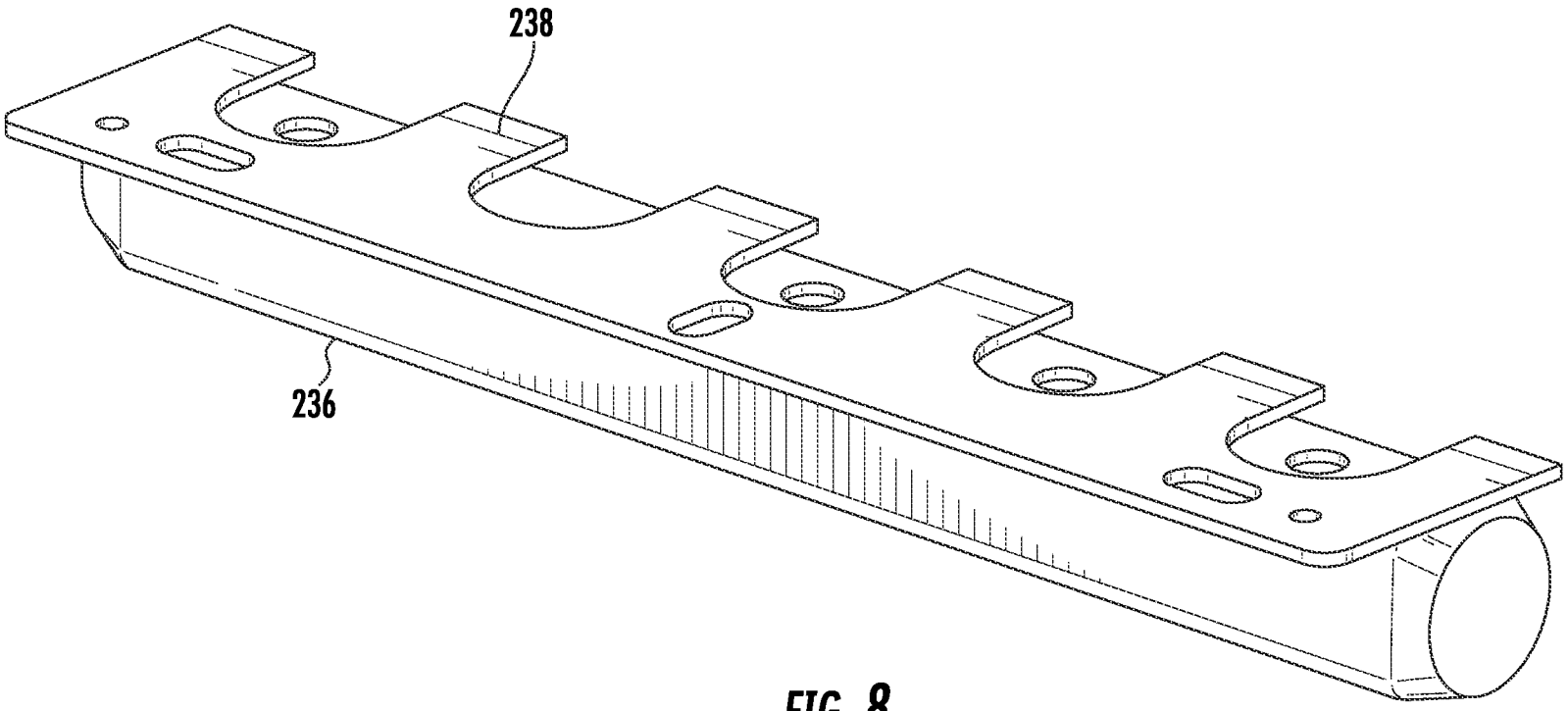
FIG. 8 provides a perspective view of an exemplary manifold tube as may be incorporated into a control panel assembly such as the exemplary control panel assembly of FIG. 3.

Individual components of the control panel assembly 200 are illustrated separately in FIGS. 7 through 12 to more clearly show certain details of each component. FIG. 7 provides a perspective view of an exemplary control valve 230, e.g., a representative one of the plurality of control valves 230, it being understood that each control valve 230 is generally similar (e.g., other than position) as the example control valve 230 illustrated in FIG. 7. FIG. 8 provides a perspective view of the manifold tube 236 and the manifold bracket 238 in isolation, e.g., without any control vales 230 or the unifying bracket 250 coupled thereto.

Figure 9:
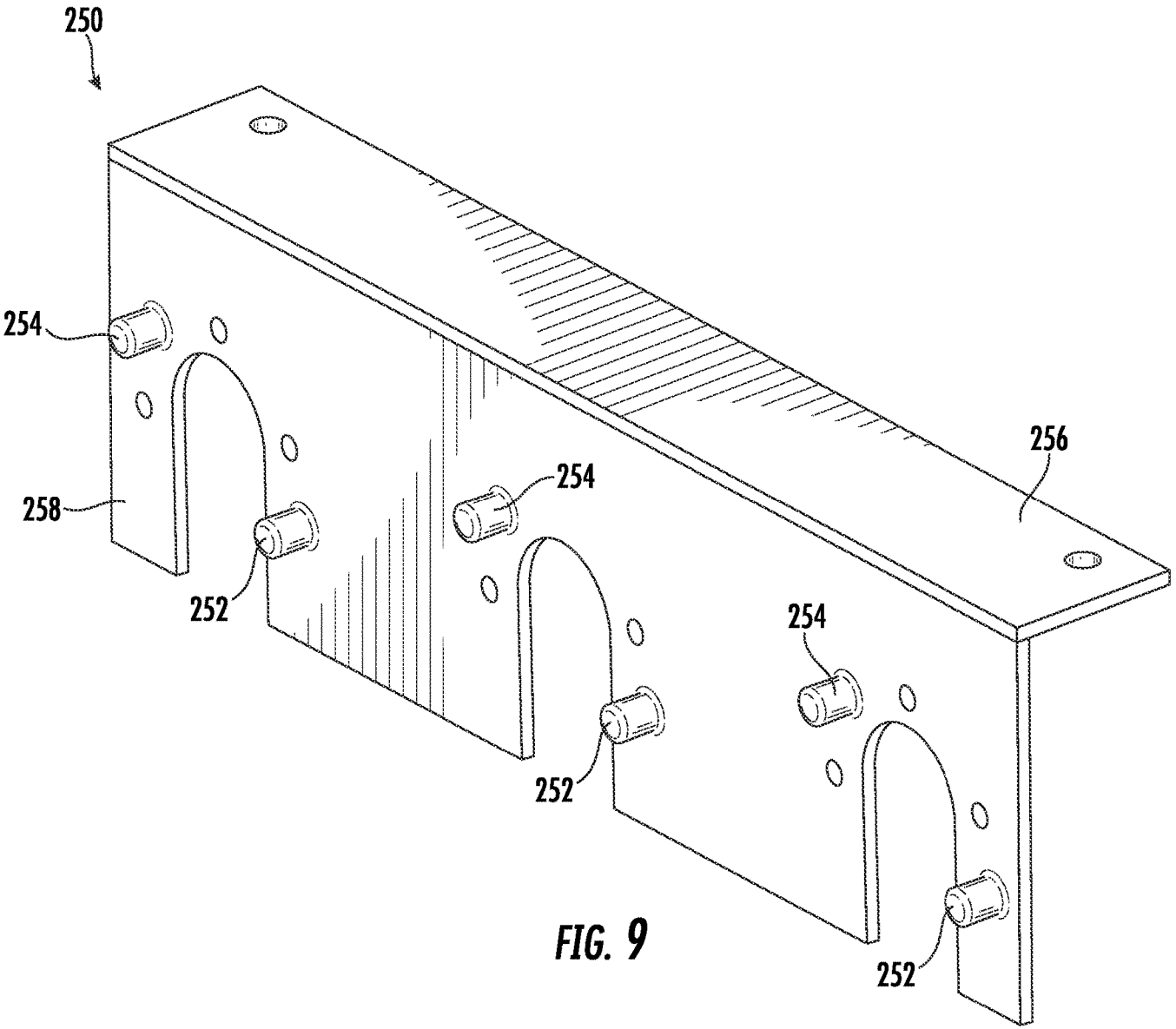
FIG. 9 provides a perspective view of an exemplary unifying bracket as may be incorporated into a control panel assembly such as the exemplary control panel assembly of FIG. 3.

FIG. 9 provides a perspective view of the unifying bracket 250. In some embodiments, e.g., as may be seen in FIG. 9, the unifying bracket 250 may include a top flange 256 and a front panel 258. The front panel 258 may be removably joined to the top flange 256. As such, when the control panel assembly 200 is assembled, e.g., as illustrated in FIGS. 3 through 6, the front panel 258 of the unifying bracket may be separated from the top flange 256 of the unifying bracket 250 to permit access to the spark switches 260 on the control valves 230 without disconnecting any of the plurality of control valves 230 from the fuel manifold 236. In some embodiments, e.g., as illustrated in FIG. 9, the unifying bracket 250 may include a plurality of protrusions thereon, such as a first plurality of protrusions 252 and a second plurality of protrusions 254.

Figure 10:
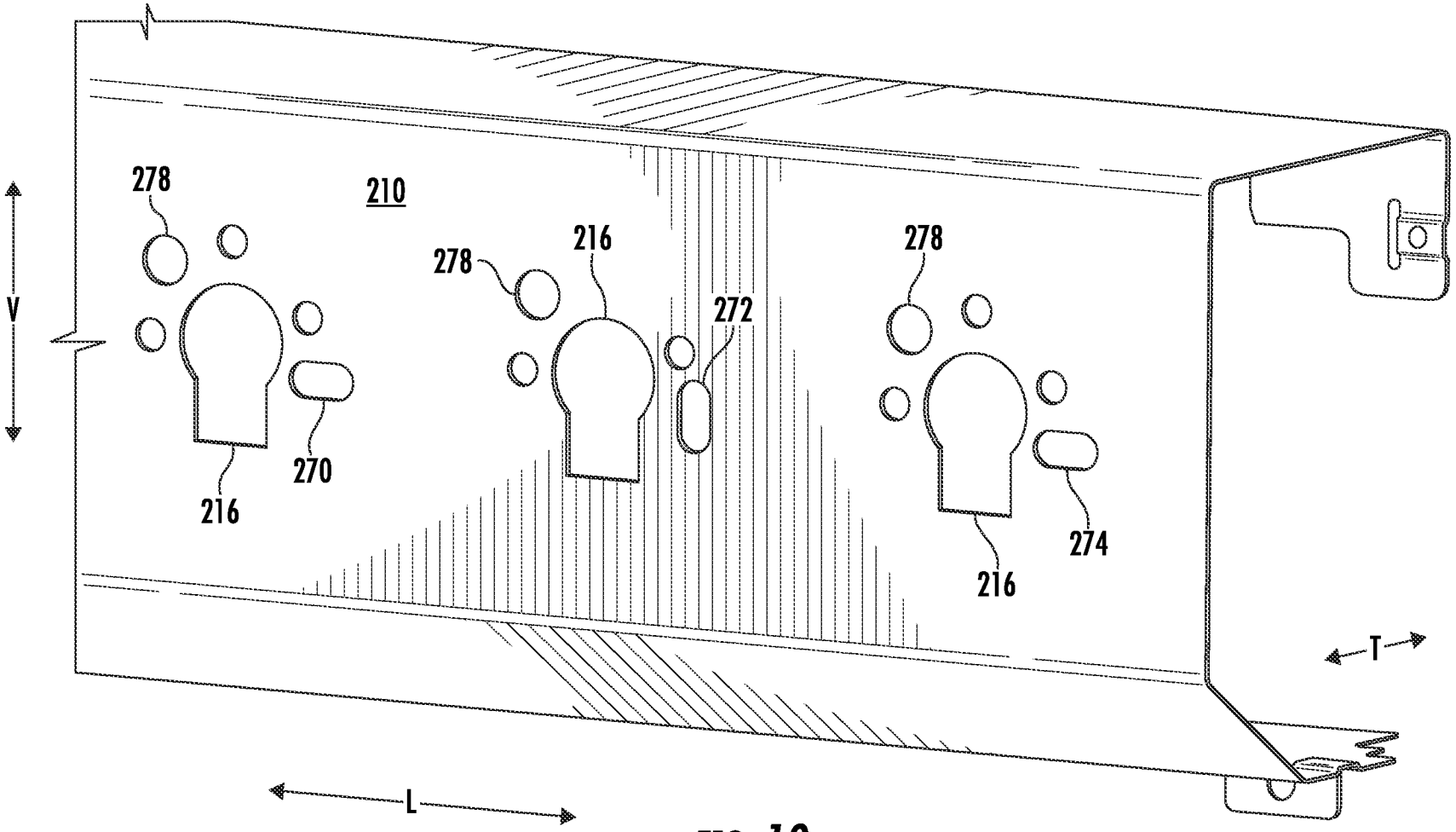
FIG. 10 provides a perspective view of a portion of an exemplary control panel as may be incorporated into a control panel assembly such as the exemplary control panel assembly of FIG. 3.

FIG. 10 provides a perspective view of a portion of the panel 210 including three openings 216 defined therethrough, which may each accept one control valve 230 of the plurality of control valves 230, such as each valve stem 234 of three control valves 230 may extend through a respective one of the openings 216 in the panel 210. As will be described in more detail below, each opening 216 may have an alignment slot 270, 272, or 274 and a clearance hole 278 associated therewith, e.g., positioned adjacent thereto. For example, each alignment slot may be positioned adjacent a respective one opening 216, and each opening 216 may also have one clearance hole 278 positioned adjacent thereto. In some embodiments, e.g., as illustrated in FIG. 10, each opening 216 has a single alignment slot and a single clearance hole 278 adjacent thereto, e.g., a single alignment slot and a single clearance hole are each much closer to each opening 216 than to every other opening 216. Moreover, there may be a mutual one-to-one correspondence between the alignment slots and the openings 216 and between the clearance holes 278 and the openings 216, such as each opening 216 has a single alignment slot adjacent thereto and each alignment slot is adjacent to a single opening 216, as well as each opening 216 has a single clearance hole 278 adjacent thereto and each clearance hole 278 is adjacent to a single opening 216. Again, as noted above, the adjacency of the clearance holes and alignment slots to the openings 216 used herein refers to each slot or hole being much closer to one of the openings 216 than to any other opening 216, which may be seen, for example, in FIG. 10. With each opening 216 having a single alignment slot 270, 272, or 274 and a single clearance hole 278 adjacent thereto, the alignment slot and the clearance hole 278 may be positioned on opposite sides of the respective opening 216, e.g., as illustrated in FIG. 10. For example, each alignment slot and each clearance hole in the panel may be positioned opposite each other about the respective one opening 216 along the vertical direction V and along the lateral direction L.

Also illustrated in FIG. 10 are a plurality of alignment slots in the panel 210. In particular, the exemplary embodiment of a panel 210 illustrated in FIG. 10 includes three alignment slots, a first alignment slot 270, a second alignment slot 274 and a third alignment slot 272. The alignment slots 270, 272, and 274 each generally define an elongated shape, e.g., a shape having a major axis or dimension which is larger than and generally perpendicular to a smaller minor axis or minor dimension. For example, the alignment slots may have an oval cross-sectional shape in some embodiments. As another example, the illustrated embodiment includes stadium-shaped alignment slots, e.g., each of the alignment slots 270, 272, and 274 defines a stadium-shaped cross-section through the panel 210, e.g., between the outer surface 212 and the inner surface 214 of the panel 210. Accordingly, the alignment slots 270, 272, and 274 each have an alignment, e.g., a direction that the major dimension of each alignment slot is oriented along and/or parallel to. For example, in some embodiments, the plurality of alignment slots defined in the panel 210 may include at least one lateral alignment slot and at least one vertical alignment slot, e.g., at least one alignment slot having a major dimension oriented generally parallel to the lateral direction L and at least one alignment slot having a major dimension oriented generally parallel to the vertical direction V. As another example, the plurality of alignment slots defined in the panel may include three alignment slots, e.g., first alignment slot 270, second alignment slot 274 and third alignment slot 272. The three alignment slots may include a first alignment slot 270 and second alignment slot 274 that are each oriented along a first direction, e.g., the lateral direction L as illustrated in FIG. 10, and a third alignment slot 272 oriented along a second direction generally perpendicular to the first direction, e.g., the vertical direction V as illustrated in FIG. 10. In some embodiments, the alignment slot which is oriented along a different direction than the direction along which the other alignment slots are oriented, e.g., the vertical alignment slot 272 in FIG. 10, may be positioned between the other two alignment slots. For example, as illustrated in FIG. 10, the third alignment slot 272 may be positioned between the first alignment slot 270 and the second alignment slot 274, such as along the lateral direction L. Other orientations and combinations of orientations are also possible within the scope of the present disclosure, such as one lateral alignment slot and two vertical alignment slots, etc.

Figure 11:
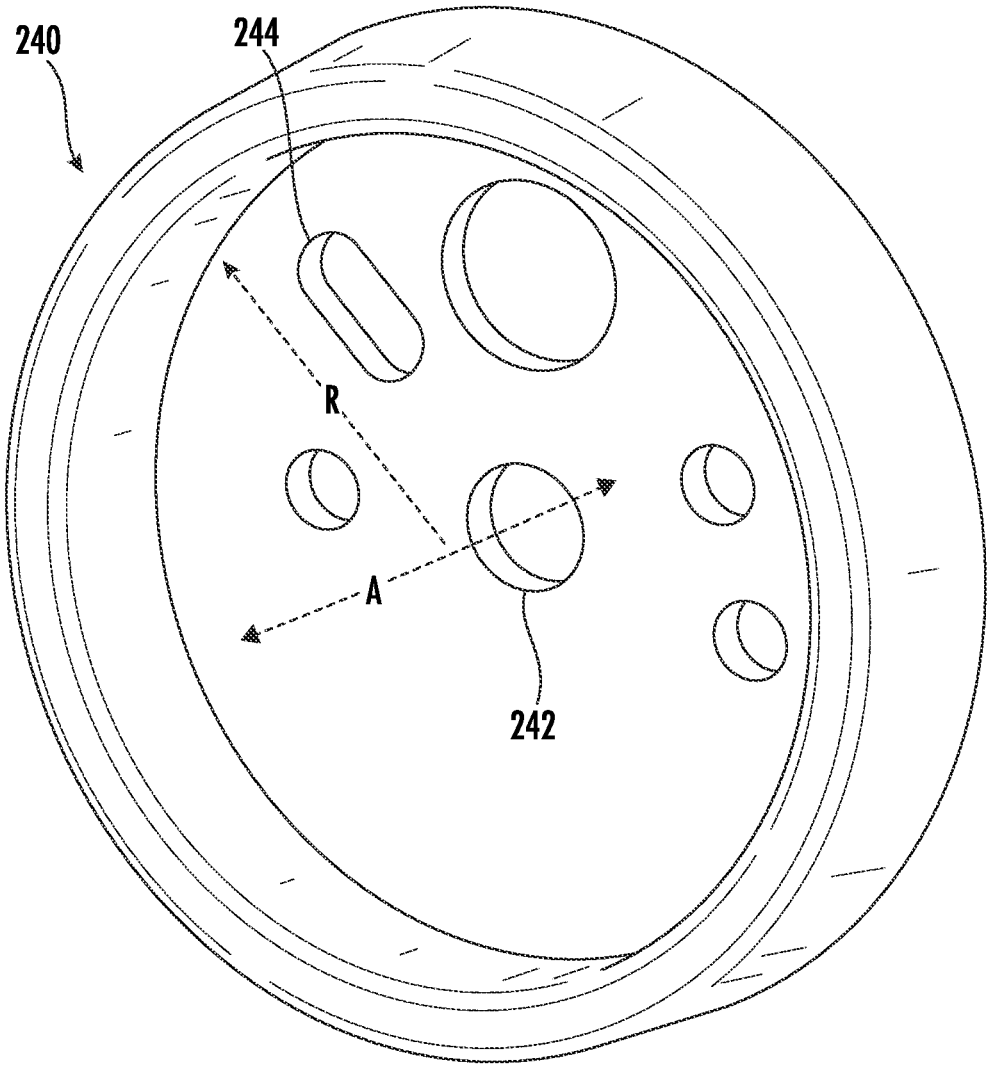
FIG. 11 provides a perspective view of an exemplary bezel as may be incorporated into a control panel assembly such as the exemplary control panel assembly of FIG. 3.

FIG. 11 provides a perspective view of an exemplary one bezel 240 of the plurality of bezels. As mentioned above, an axial direction A may be defined, e.g., by the valve stem 234. As illustrated in FIG. 11, the bezel 240 may include a central aperture 242 through which the valve stem 234 of the corresponding control valve 230 may extend, e.g., along the axial direction A. Further, a radial direction R may be defined perpendicular to the axial direction A. In some embodiments, the bezel 240 may include a control slot 244 defined therein. For example, as illustrated in FIG. 11, the control slot 244, such as a major dimension thereof, may be oriented generally parallel to the radial direction R.

Figure 12:
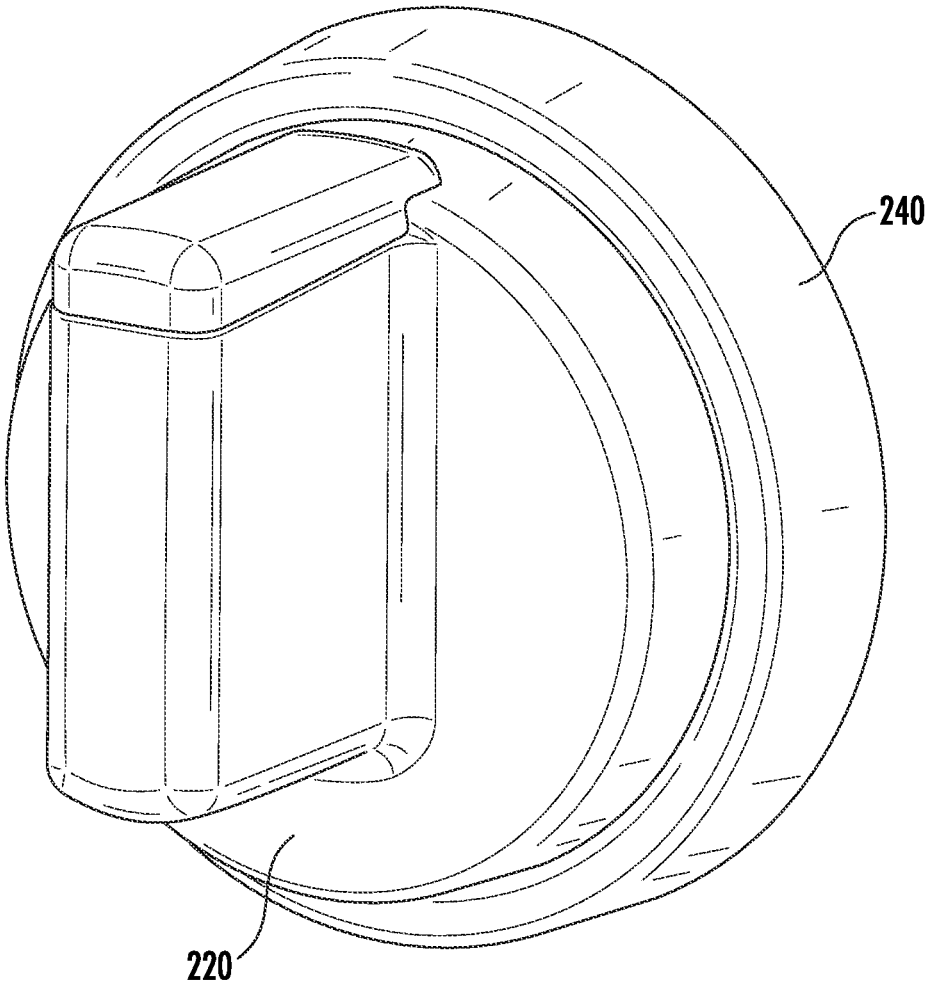
FIG. 12 provides a perspective view of an exemplary knob and bezel as may be incorporated into a control panel assembly such as the exemplary control panel assembly of FIG. 3.

FIG. 12 provides a perspective view of an exemplary one of the bezels 240 with a corresponding knob 220 received therein. As may be seen in FIG. 12, the knob 220 is generally concentrically aligned with and positioned within the bezel 240. Accordingly, a spacing between the outermost perimeter, e.g., circumference, of the knob 220 is evenly spaced along the entirety thereof from a corresponding dimension of the bezel 240, such as an internal circumference of the bezel 240.

Figure 13:
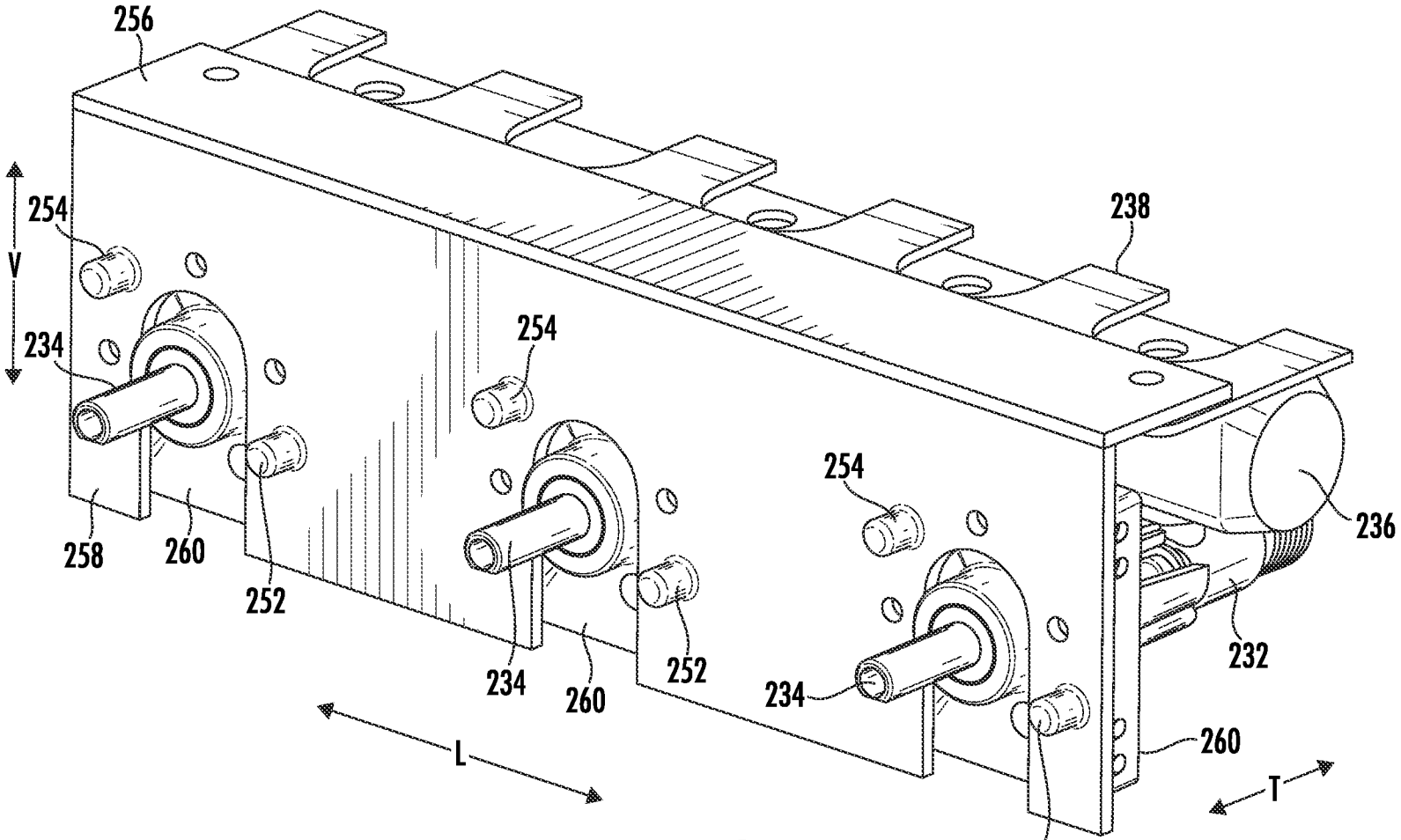
FIG. 13 provides a perspective view of a partially assembled control panel assembly including an exemplary manifold tube with a plurality of exemplary control valves coupled thereto and an exemplary unifying bracket mounted to a bracket of the manifold tube.

FIG. 13 provides a perspective view of a partially assembled control panel assembly 200. Illustrated in FIG. 13 are an exemplary manifold tube 236 with a plurality of exemplary control valves 230 coupled thereto. Also as may be seen in FIG. 13, an exemplary unifying bracket 250 is coupled to the bracket 238 of the manifold tube 236. Each control valve 230 extends partially through the unifying bracket 250. For example, the spark switch 260 of each control valve 230 may be positioned on one side of the unifying bracket 250 while the valve stem 234 of each control valve 230 is positioned on an opposite side of the unifying bracket 250.

Figure 14:
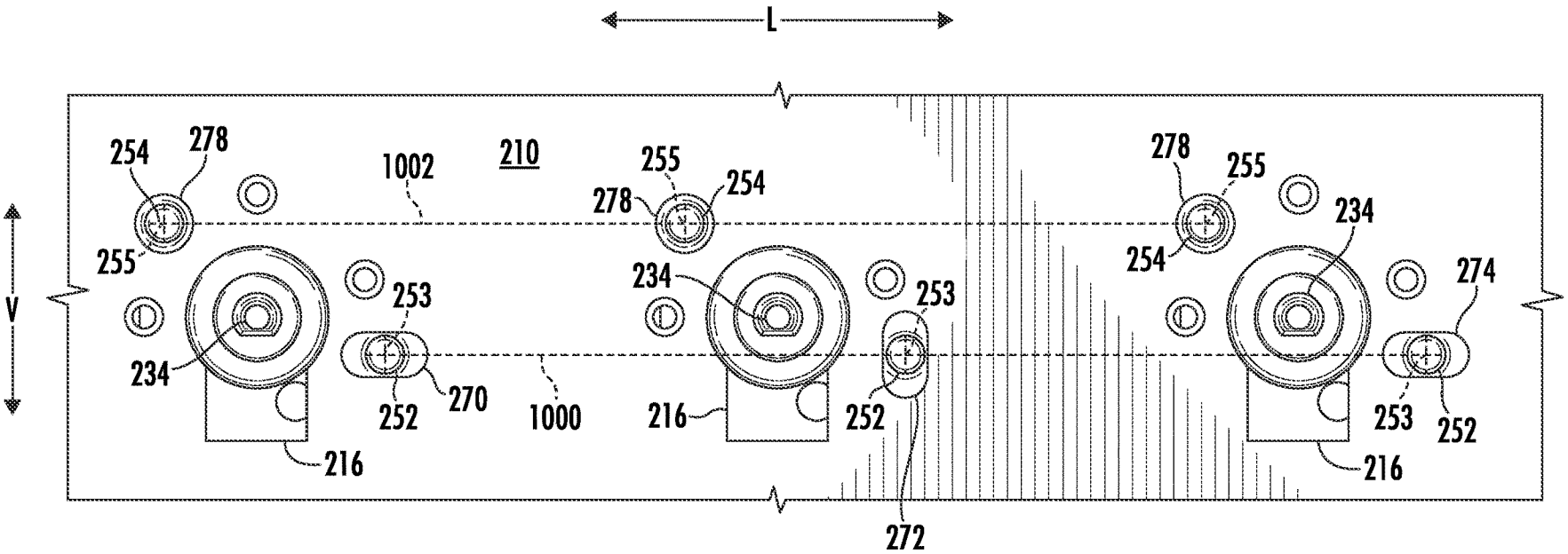
FIG. 14 provides a front view of the partially assembled control panel assembly of FIG. 13.

FIG. 14 provides a front view of a partially assembled control panel assembly 200. In particular, the bezels 240 and knobs 220 are not installed in FIG. 14, e.g., FIG. 14 depicts the panel 210 with a plurality of control valves 230, e.g., three control valves in this example, mounted therebehind, such that the valves stems 234 of the control valves 230 each extend through a respective opening 216 in the panel 210. The unifying bracket 250 is positioned behind the panel 210 in FIG. 14, whereby protrusions of the unifying bracket 250 may be seen. In particular, the first plurality of protrusions 252 of the unifying bracket 250 each extend through a corresponding one of the alignment slots 270, 272, and 274 in the panel 210. The first plurality of protrusions 252 and the alignment slots 270, 272, and 274 may thereby cooperatively provide translational control of the control valves 230 and the panel 210, e.g., the first plurality of protrusions 252 and the alignment slots 270, 272, and 274 may cooperatively restrict or prevent relative translational movement between the control valves 230 and the panel 210, such as along the lateral direction L, along the vertical direction V, and/or within a lateral-vertical plane defined by the lateral direction L and the vertical direction V. At the stage of assembly depicted in FIG. 14, the second plurality of protrusions 254 each extend through, but do not contact, a respective one clearance hole 278 of the plurality of clearance holes 278 in the panel 210.

In some embodiments, e.g., as illustrated in FIG. 14, each protrusion 252 of the first plurality of protrusions 252 may define a center point 253. In such embodiments, the center points 253 of the first plurality of protrusions 252 may be colinear along a line 1000 that is generally parallel to the lateral direction L. Further, each protrusion 254 of the second plurality of protrusions 254 may define a center point 255, and the center points 255 of the second plurality of protrusions 254 may be colinear along a line 1002 that is generally parallel to the lateral direction L.

Figure 15:
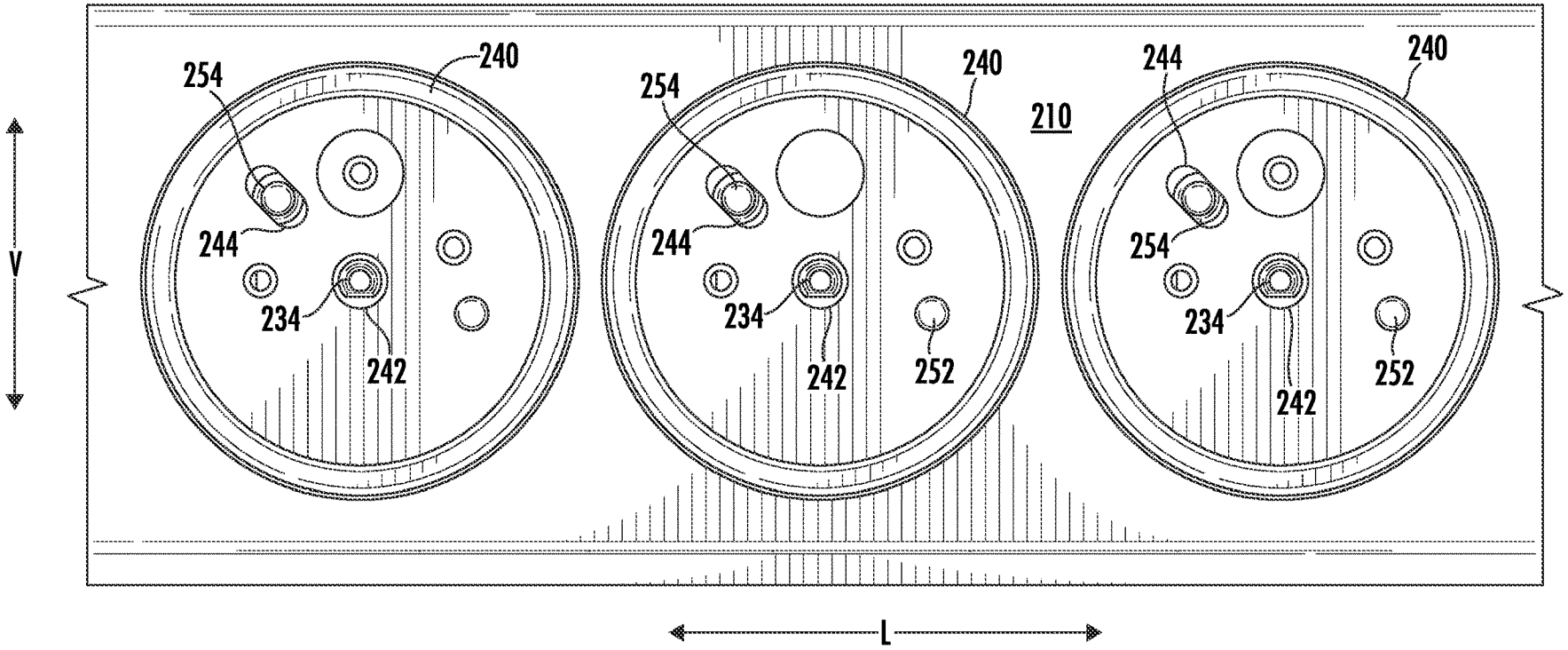
FIG. 15 provides a front view of the partially assembled control panel assembly of FIG. 13 with the addition of a plurality of bezels thereon.

FIG. 15 provides another front view of a partially assembled control panel assembly 200. In particular, the bezels 240 have been installed and only the knobs 220 are omitted in FIG. 15. For example, the configuration illustrated in FIG. 15 may represent a next step in the assembly process after the configuration illustrated in FIG. 14. As illustrated in FIG. 15, each protrusion 254 of the second plurality of protrusions 254 on the unifying bracket 250 extends through the control slot 244 of a respective one of the plurality of bezels 240. The controls slots 244 and the second plurality of protrusions 254 may cooperatively provide rotational control of the bezels 240 and the panel 210, e.g., the second plurality of protrusions 254 and the control slots 244 may cooperatively restrict or prevent relative rotational movement between the bezels 240 and the panel 210, such as around the axial direction A (see, e.g., FIG. 3, and note that the axial direction A is oriented into and out of the page in the view of FIG. 15).

Figure 16:
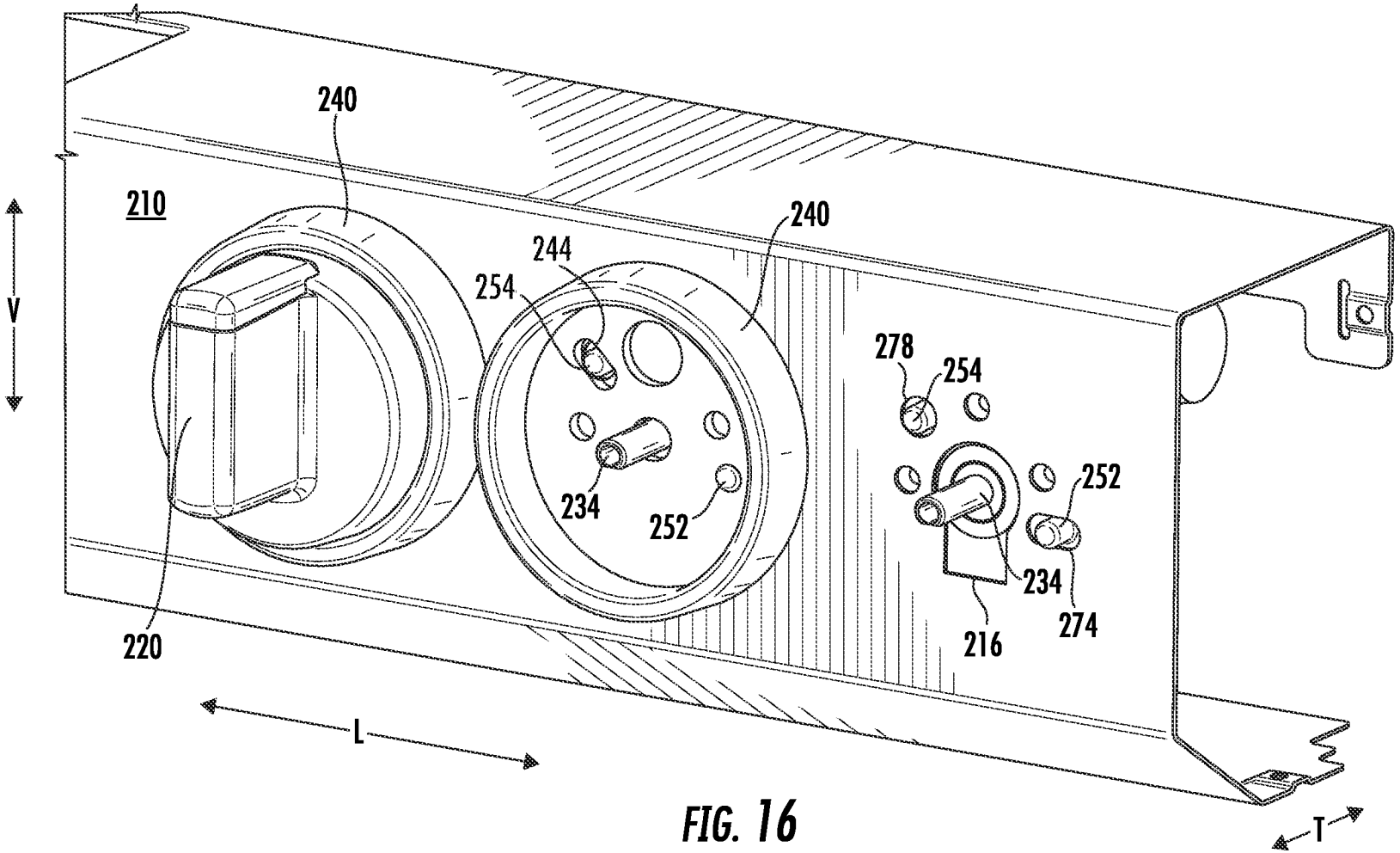
FIG. 16 provides a perspective view of a partially assembled control panel assembly including an exemplary knob and bezel associated with a first control valve, an exemplary bezel without the knob associated with a second control valve, and third control valve having neither a bezel nor a knob associated therewith.

FIG. 16 provides a perspective view of a portion of the control panel assembly 200 in varying stages of completeness of the assembly process. Moving from left to right on the page in FIG. 16, one knob 220 and bezel 240 are fully assembled onto a corresponding control valve 230 and the panel 210, while a second control valve 230 (of which the control stem 234 is visible in FIG. 16) has the bezel 240 assembled around the valve stem 234 thereof (the valve stem 234 extends through the aperture 242 in the bezel 240, but does not contact the edges thereof) with a corresponding second protrusion 254 of the unifying bracket 250 within the control slot 244 of the bezel 240. A third control valve 230 is mounted to the unifying bracket 250 and the panel 210 without a bezel 240 or knob 220 yet connected to the control valve 230. At the third control valve 230, the first protrusion 252 within the alignment slot 274 and the second protrusion 254 extending through the clearance hole 278 may be seen.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance, comprising:

a panel defining a plurality of openings;

a plurality of clearance holes defined in the panel, each clearance hole of the plurality of clearance holes positioned adjacent a respective one opening of the plurality of openings;

a plurality of control valves mounted to the panel, each control valve of the plurality of control valves comprising a spark switch and a stem, the stem of each control valve extending through the panel at one corresponding opening of the plurality of openings of the panel;

a plurality of knobs, each knob mounted to the stem of a respective one control valve of the plurality of control valves and positioned opposite the spark switch of the respective one control valve about the panel;

a plurality of bezels positioned at the panel whereby each bezel of the plurality of bezels is disposed between a corresponding one knob of the plurality of knobs and the panel, each bezel of the plurality of bezels comprising a control slot defined therein; and a unifying bracket positioned between the spark switch of each control valve of the plurality of control valves and the panel, the unifying bracket comprising a plurality of protrusions, each protrusion of the plurality of protrusions of the unifying bracket extending through a respective one of the plurality of clearance holes in the panel and through the control slot of a respective one bezel of the plurality of bezels, wherein the unifying bracket comprises a top flange and a front panel removably joined to the top flange, whereby the front panel of the unifying bracket may be separated from the top flange of the unifying bracket to permit access to the spark switch of each control valve of the plurality valves without disconnecting the plurality of control valves from a fuel manifold.

2. The cooktop appliance of claim 1, further comprising a plurality of alignment slots defined in the panel, each alignment slot of the plurality of alignment slots positioned adjacent a respective one opening of the plurality of openings, wherein the plurality of protrusions is a first plurality of protrusions of the unifying bracket, further comprising a second plurality of protrusions defined on the unifying bracket, each protrusion of the second plurality of protrusions extending through a respective one of the plurality of alignment slots.

3. The cooktop appliance of claim 2, wherein the plurality of alignment slots defined in the panel comprises a lateral alignment slot and a vertical alignment slot.

4. The cooktop appliance of claim 2, wherein the plurality of alignment slots defined in the panel comprises three alignment slots, the three alignment slots comprising a first alignment slot and a second alignment slot each oriented along a first direction, and a third alignment slot oriented along a second direction generally perpendicular to the first direction.

5. The cooktop appliance of claim 4, wherein the third alignment slot is positioned between the first alignment slot and the second alignment slot.

6. The cooktop appliance of claim 2, wherein the panel defines a vertical direction and a lateral direction perpendicular to the vertical direction, wherein each protrusion of the second plurality of protrusions defines a center point, and wherein the center points of the second plurality of protrusions are colinear along a line that is generally parallel to the lateral direction.

7. The cooktop appliance of claim 2, wherein the panel defines a vertical direction and a lateral direction perpendicular to the vertical direction, and wherein each alignment slot and each clearance hole in the panel are positioned opposite each other about the respective one opening of the plurality of openings along the vertical direction and along the lateral direction.

8. The cooktop appliance of claim 1, wherein the panel defines a vertical direction and a lateral direction perpendicular to the vertical direction, wherein each protrusion of the plurality of protrusions defines a center point, and wherein the center points of the plurality of protrusions are colinear along a line that is generally parallel to the lateral direction.

9. The cooktop appliance of claim 1, wherein the control slot of each bezel is oriented along a radial direction.

10. A cooktop appliance, comprising:

a panel defining a plurality of openings;

a plurality of alignment slots defined in the panel, each alignment slot of the plurality of alignment slots positioned adjacent a respective one opening of the plurality of openings, wherein the plurality of alignment slots defined in the panel comprises a lateral alignment slot and a vertical alignment slot;

a plurality of control valves mounted to the panel, each control valve of the plurality of control valves comprising a spark switch and a stem, the stem of each control valve extending through the panel at one corresponding opening of the plurality of openings of the panel;

a plurality of knobs, each knob mounted to the stem of a respective one control valve of the plurality of control valves and positioned opposite the spark switch of the respective one control valve about the panel; and a unifying bracket positioned between the spark switch of each control valve of the plurality of control valves and the panel, the unifying bracket comprising a plurality of protrusions, each protrusion of the plurality of protrusions of the unifying bracket extending through a respective one of the plurality of alignment slots.

11. The cooktop appliance of claim 10, further comprising a plurality of clearance holes defined in the panel, each clearance hole of the plurality of clearance holes positioned adjacent a respective one opening of the plurality of openings and a plurality of bezels positioned at the panel whereby each bezel of the plurality of bezels is disposed between a corresponding one knob of the plurality of knobs and the panel, each bezel of the plurality of bezels comprising a control slot defined therein, wherein the plurality of protrusions is a first plurality of protrusions of the unifying bracket, further comprising a second plurality of protrusions defined on the unifying bracket, each protrusion of the second plurality of protrusions extending through a respective one of the plurality of clearance holes in the panel and through the control slot of a respective one bezel of the plurality of bezels.

12. The cooktop appliance of claim 11, wherein the panel defines a vertical direction and a lateral direction perpendicular to the vertical direction, wherein each protrusion of the second plurality of protrusions defines a center point, and wherein the center points of the second plurality of protrusions are colinear along a line that is generally parallel to the lateral direction.

13. The cooktop appliance of claim 11, wherein the control slot of each bezel is oriented along a radial direction.

14. The cooktop appliance of claim 11, wherein the panel defines a vertical direction and a lateral direction perpendicular to the vertical direction, and wherein each alignment slot and each clearance hole in the panel are positioned opposite each other about the respective one opening of the plurality of openings along the vertical direction and along the lateral direction.

15. The cooktop appliance of claim 10, wherein the panel defines a vertical direction and a lateral direction perpendicular to the vertical direction, wherein each protrusion of the plurality of protrusions defines a center point, and wherein the center points of the plurality of protrusions are colinear along a line that is generally parallel to the lateral direction.

16. The cooktop appliance of claim 10, wherein the unifying bracket comprises a top flange and a front panel removably joined to the top flange, whereby the front panel of the unifying bracket may be separated from the top flange of the unifying bracket to permit access to the spark switch of each control valve of the plurality valves without disconnecting the plurality of control valves from a fuel manifold.

17. A cooktop appliance, comprising:

a panel defining a plurality of openings;

a plurality of alignment slots defined in the panel, each alignment slot of the plurality of alignment slots positioned adjacent a respective one opening of the plurality of openings, wherein the plurality of alignment slots defined in the panel comprises three alignment slots, the three alignment slots comprising a first alignment slot and a second alignment slot each oriented along a first direction, and a third alignment slot oriented along a second direction generally perpendicular to the first direction;

a plurality of control valves mounted to the panel, each control valve of the plurality of control valves comprising a spark switch and a stem, the stem of each control valve extending through the panel at one corresponding opening of the plurality of openings of the panel;

a plurality of knobs, each knob mounted to the stem of a respective one control valve of the plurality of control valves and positioned opposite the spark switch of the respective one control valve about the panel; and a unifying bracket positioned between the spark switch of each control valve of the plurality of control valves and the panel, the unifying bracket comprising a plurality of protrusions, each protrusion of the plurality of protrusions of the unifying bracket extending through a respective one of the plurality of alignment slots.

18. The cooktop appliance of claim 17, wherein the third alignment slot is positioned between the first alignment slot and the second alignment slot.

19. The cooktop appliance of claim 17, wherein the panel defines a vertical direction and a lateral direction perpendicular to the vertical direction, wherein each protrusion of the plurality of protrusions defines a center point, and wherein the center points of the plurality of protrusions are colinear along a line that is generally parallel to the lateral direction.

20. The cooktop appliance of claim 17, wherein the unifying bracket comprises a top flange and a front panel removably joined to the top flange, whereby the front panel of the unifying bracket may be separated from the top flange of the unifying bracket to permit access to the spark switch of each control valve of the plurality valves without disconnecting the plurality of control valves from a fuel manifold.

* * * * *